US008622649B1

(12) United States Patent
Peeroo et al.

(10) Patent No.: US 8,622,649 B1
(45) Date of Patent: Jan. 7, 2014

(54) SCREEN LIMESTONE LEVELING AND SMOOTHING TOOL

(76) Inventors: Swadick Peeroo, Markham (CA); Parveen Peeroo, Markham (CA)

( * ) Notice: Subject to any disclaimer, the term of this patent is extended or adjusted under 35 U.S.C. 154(b) by 0 days.

(21) Appl. No.: 13/526,634

(22) Filed: Jun. 19, 2012

(51) Int. Cl.
*E01C 19/22* (2006.01)

(52) U.S. Cl.
USPC ..... 404/119

(58) Field of Classification Search
USPC ..... 404/118, 119
See application file for complete search history.

(56) References Cited

U.S. PATENT DOCUMENTS

| | | | | | |
|---|---|---|---|---|---|
| 985,214 | A * | 2/1911 | Shroyer | 404/119 |
| 1,773,431 | A * | 8/1930 | Mosel | 404/119 |
| 3,572,227 | A * | 3/1971 | Poulsen | 404/104 |
| 5,249,365 | A | 10/1993 | Santiago | |
| 5,468,095 | A * | 11/1995 | Dawson | 404/118 |
| D399,772 | S | 10/1998 | Sanden | |
| 5,979,879 | A | 11/1999 | Asplin | |
| 6,053,659 | A | 4/2000 | Burton et al. | |
| 6,223,495 | B1 * | 5/2001 | Shaw et al. | 52/749.1 |
| 6,412,185 | B1 | 7/2002 | Mills et al. | |
| 6,830,409 | B2 * | 12/2004 | Carlson | 404/118 |
| 7,254,920 | B2 | 8/2007 | Steele | |
| 7,470,083 | B2 * | 12/2008 | Black | 404/97 |
| D597,873 | S | 8/2009 | Gofer | |
| 2005/0249554 | A1 * | 11/2005 | Anibaldi et al. | 404/118 |
| 2009/0226257 | A1 | 9/2009 | Lindley | |

* cited by examiner

*Primary Examiner* — Thomas B Will
*Assistant Examiner* — Abigail A Risic

(57) ABSTRACT

The screen limestone leveling and smoothing tool includes a first and second telescoping members that each include rollers at distal ends for use in rolling the tool across pieces of generally parallel timber in order to even and smooth out a layer of crushed limestone or sand. The screen limestone leveling and smoothing tool includes blade members under each of the first and second telescoping members, which engages across a top surface of the crushed limestone or sand, and which are offset from one another in order to enable the telescoping members to adjust an overall length formed thereon. The blade members are pushed across the top surface of the crushed limestone or sand, and smooth and even the top surface.

8 Claims, 5 Drawing Sheets

SCREEN LIMESTONE LEVELING AND SMOOTHING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of limestone and/or sand leveling equipment, more specifically, a leveling and smoothing tool for use with screen limestone or sand.

Spreading out sand or crushed limestone is a common task performed prior to laying brick pavers or like building materials when constructing a walkway, a garage driveway, or other surface. Building a brick paver surface requires some effort in laying the proper sub-surfaces in order to support the brick pavers thereon. Commonly, a compacted sub surface is formed in order to support the weight of the brick pavers. Usually a layer of crushed limestone is placed down and compacted before laying a thin layer of sand thereon. The crushed limestone and sand layers usually are sandwiched between the compacted sub surface and the brick pavers in order to even a layer of sand or crushed limestone it is desirable to ensure that the entire layer is smooth and even, which can be tricky. This is especially tricky when the crushed limestone is going to be subsequently compacted down via a tamper or mechanical compactor.

What is needed is a tool and method of use that ensures that the layer of sand or limestone being placed is both smooth and even. The device of the present application seeks to address this need by providing a telescoping tool that can be adapted for use and rolled across two generally parallel pieces of timber, and whereby the rolling of said tool shall generate a smooth and even surface of sand or crushed limestone.

B. Discussion of the Prior Art

As will be discussed immediately below, no prior art discloses a leveling and smoothing tool for use with sand or crushed limestone that includes a first and second telescoping members that each include rollers at distal ends for use in rolling the tool across pieces of timber; wherein the first and second telescoping members each include a blade member there under, which engages across a top surface of the material being smoothed and evened via the tool; wherein the first and second telescoping members extend and retract with respect to one another in order to adjust an overall length formed between distal ends whereby the rollers roll across the pieces of timber.

The Lindley Patent (U.S. Patent No. 2009/0226257) discloses a screed rail system for placing uncured concrete that includes a pair of rails positioned to lie spaced-apart and parallel to one another and a screed plate supported between the rails to move along the rails to form a final grade level of uncured concrete in a work area. However, the screed system is for use in placing uncured concrete, and is not a telescoping tool that rolls along generally parallel pieces of timber in order to smooth and even crushed limestone or sand for use with laying brick pavers.

The Burton et al. Patent (U.S. Pat. No. 6,053,659) discloses an inlaid brick walkway leveler consisting of a handle affixed to a rakehead with the handle being supported by a pair of equivalent mediolateral struts. However, the leveler is articulated via an attached handle, and is not a tool that rolls atop of generally parallel pieces of timber.

The Mills et al. Patent (U.S. Pat. No. 6,412,185) discloses a tile laying gauge and leveling assembly for preparing a recipient surface for the laying of tiles and for properly positioning the tiles on the recipient surface that includes a plurality of elongated side members and a leveling assembly. However, the leveling assembly is not a telescoping tool that rolls atop of two parallel pieces of wood in order to level and smooth out crushed limestone or sand prior to placement of brick pavers.

The Asplin Patent (U.S. Pat. No. 5,979,879) discloses a method of repairing sidewalks that are damaged due to settling or changes in the elevation of the earth upon which they are built. Again, the method does not involve the use of a telescoping tool that rolls atop of parallel pieces of timber, and that smooths and evens out sand or crushed limestone.

The Steele Patent (U.S. Pat. No. 7,254,920) discloses a device for setting and leveling tile. However, the device is used to ensure a level placement of a ceramic tile, and not for smoothing and leveling a subsurface for placement of brick pavers.

The Santiago Patent (U.S. Pat. No. 5,249,365) discloses a telescoping level apparatus. Again, the apparatus does not roll atop of two generally parallel pieces of timber in order to smooth and level a layer of sand or crushed limestone prior to installation of brick pavers.

While the above-described devices fulfill their respective and particular objects and requirements, they do not describe a leveling and smoothing tool for use with sand or crushed limestone that includes a first and second telescoping members that each include rollers at distal ends for use in rolling the tool across pieces of timber; wherein the first and second telescoping members each include a blade member there under, which engages across a top surface of the material being smoothed and evened via the tool; wherein the first and second telescoping members extend and retract with respect to one another in order to adjust an overall length formed between distal ends whereby the rollers roll across the pieces of timber. In this regard, the screen limestone leveling and smoothing tool departs from the conventional concepts and designs of the prior art.

SUMMARY OF THE INVENTION

The screen limestone leveling and smoothing tool includes a first and second telescoping members that each include rollers at distal ends for use in rolling the tool across pieces of generally parallel timber in order to even and smooth out a layer of crushed limestone or sand. The screen limestone leveling and smoothing tool includes blade members under each of the first and second telescoping members, which engages across a top surface of the crushed limestone or sand, and which are offset from one another in order to enable the telescoping members to adjust an overall length formed thereon. The blade members are pushed across the top surface of the crushed limestone or sand, and smooth and even the top surface.

An object of the invention is to provide a tool that is used to smooth out and level a layer of sand or crushed limestone with constructing a brick paver surface.

Another object of the invention is to provide a tool that includes rollers at distal ends, which roll atop of two generally parallel pieces of timber in order to smooth and level a section of said or crushed limestone.

Another object of the invention is to include a tool that is made of telescoping members, which telescope with respect to one another in order to adjust an overall length thereby increasing the flexibility of use of the tool with respective shape and size of the layer to be smoothed and evened.

Another object of the invention is to provide a blade member that descends from underneath each of the telescoping members, and which engages the top surface of the material being smoothed and evened upon rolling the tool across the pieces of timber.

Another object of the invention is to provide rollers mounted to distal members that are each rigidly affixed to a respective telescoping member whereby the blade member is at a lowered elevation with respect to the rollers.

An even further object of the invention is to offset the blade members with one another thereby enabling the telescoping members to telescope with respect to one another without interference of the blade members engaging one another.

These together with additional objects, features and advantages of the screen limestone leveling and smoothing tool will be readily apparent to those of ordinary skill in the art upon reading the following detailed description of presently preferred, but nonetheless illustrative, embodiments of the screen limestone leveling and smoothing tool when taken in conjunction with the accompanying drawings.

In this respect, before explaining the current embodiments of the screen limestone leveling and smoothing tool in detail, it is to be understood that the screen limestone leveling and smoothing tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the screen limestone leveling and smoothing tool.

It is therefore important that the claims be regarded as including such equivalent construction insofar as they do not depart from the spirit and scope of the screen limestone leveling and smoothing tool. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
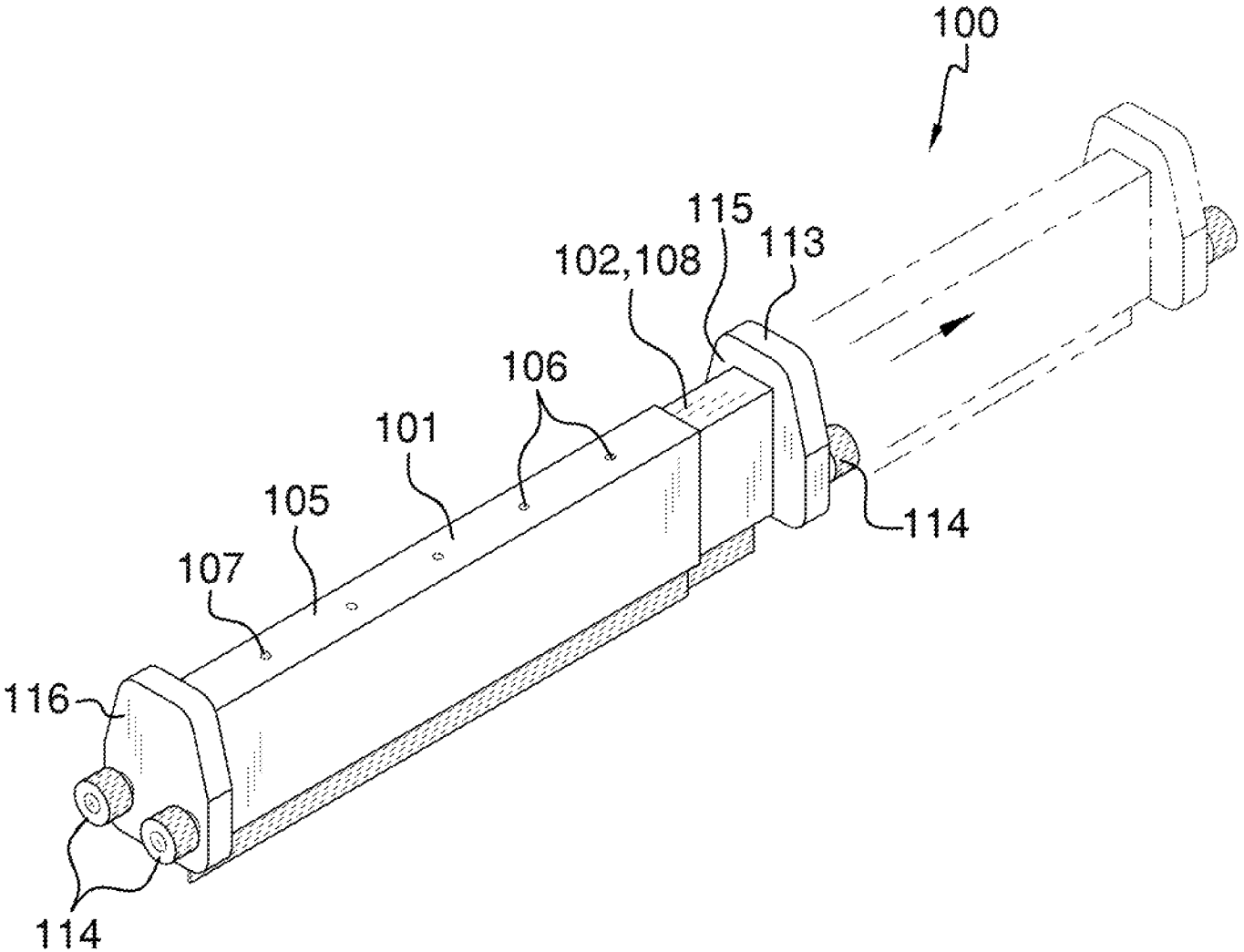
FIG. 1 illustrates a perspective view of the leveling and smoothing tool by itself and detailing the ability of the tool to telescope via the telescoping members.
Figure 2:
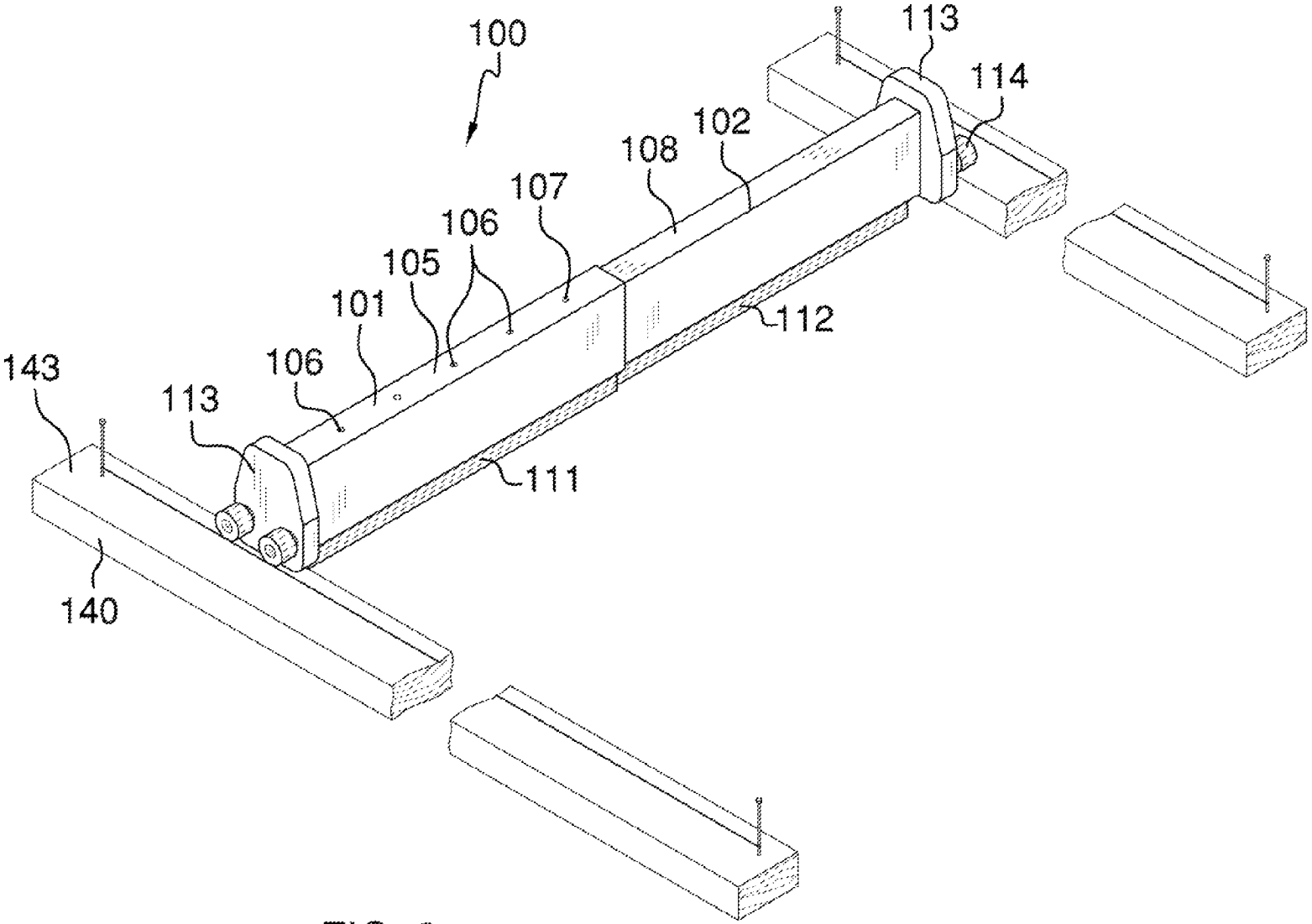
FIG. 2 illustrates a perspective view of the leveling and smoothing tool wherein the rollers are seated atop of two generally parallel pieces of timber.
Figure 3:
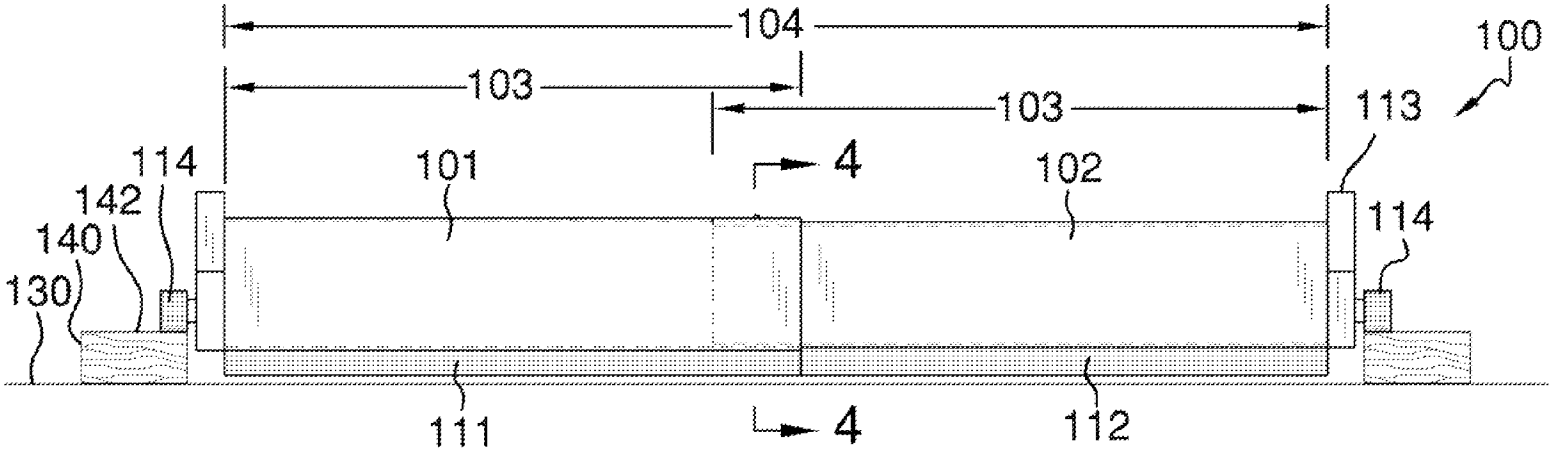
FIG. 3 illustrates an end view of the leveling and smoothing tool seated atop of the timber, and further detailing the elevation of the blade members with respect to the timber and rollers.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A screen limestone leveling and smoothing tool 100 (hereinafter invention) includes a first telescoping member 101 and a second telescoping member 102. The first telescoping member 101 and the second telescoping member 102 are telescopically engaged with one another, and are both made of a hollowed construction whereby the second telescoping member 102 extends and retracts with respect to the first telescoping member 101. The first telescoping member 101 and the second telescoping member 102 each have a rectangularly-shaped cross section (see FIG. 4), and the first telescoping member 101 has a larger cross-sectional shape when compared to the second telescoping member 102.

The first telescoping member 101 and the second telescoping member 102 each have a telescoping length 103 such that both the first telescoping member 101 and the second telescoping member 102 may be equal in length with respect to one another. The invention 100 forms an overall tool length 104 that is comprised of the length formed of the first telescoping member 101 and an exposed portion of the second telescoping member 102.

The first telescoping member 101 is further defined with a top surface 105 that includes a plurality of equally spaced holes 106 there across. The second telescoping member 102 includes a spring-loaded button 107 that is biased upwardly through a second top surface 108, and which aligns with one of the holes 106 in order to lock the invention 100 at varying overall tool lengths 104. The use of spring-loaded buttons 107 and holes 106 are well known in the art, and provide a simple means of adjusting a length formed between two components that may be telescopically engaged.

The first telescoping member 101 is further defined with a first bottom surface 109 whereby the second telescoping member 102 has a second bottom surface 110. Both the first telescoping member 101 and the second telescoping member 102 include a blade member defined as a first blade member 111 and second blade member 112, respectively. The blade members 111 and 112 are made of a thin piece of flexible material (rubber), and are used to smooth out and even a top surface 130 of material. Moreover, the blade members 111 and 112 may be made of the same material as the first and second telescoping members 101 and 102, respectively. It shall be noted that the term material is being loosely defined as any subsurface material that needs to be flattened, and may be crushed limestone or sand. The sand and crushed limestone are commonly used materials when forming a subsurface that is compacted and even prior to laying brick pavers in forming a paver surface.

Figure 4:
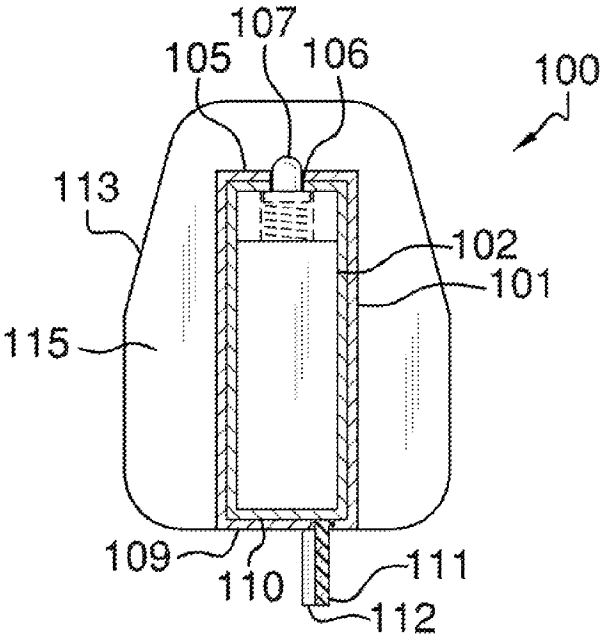
FIG. 4 illustrates a cross-sectional view of the leveling and smoothing tool along line 4-4 in FIG. 3, and detailing the construction of the telescoping members as well as the spring-loaded button used to adjust and lock the telescoping members with respect to one another.
Figure 5:
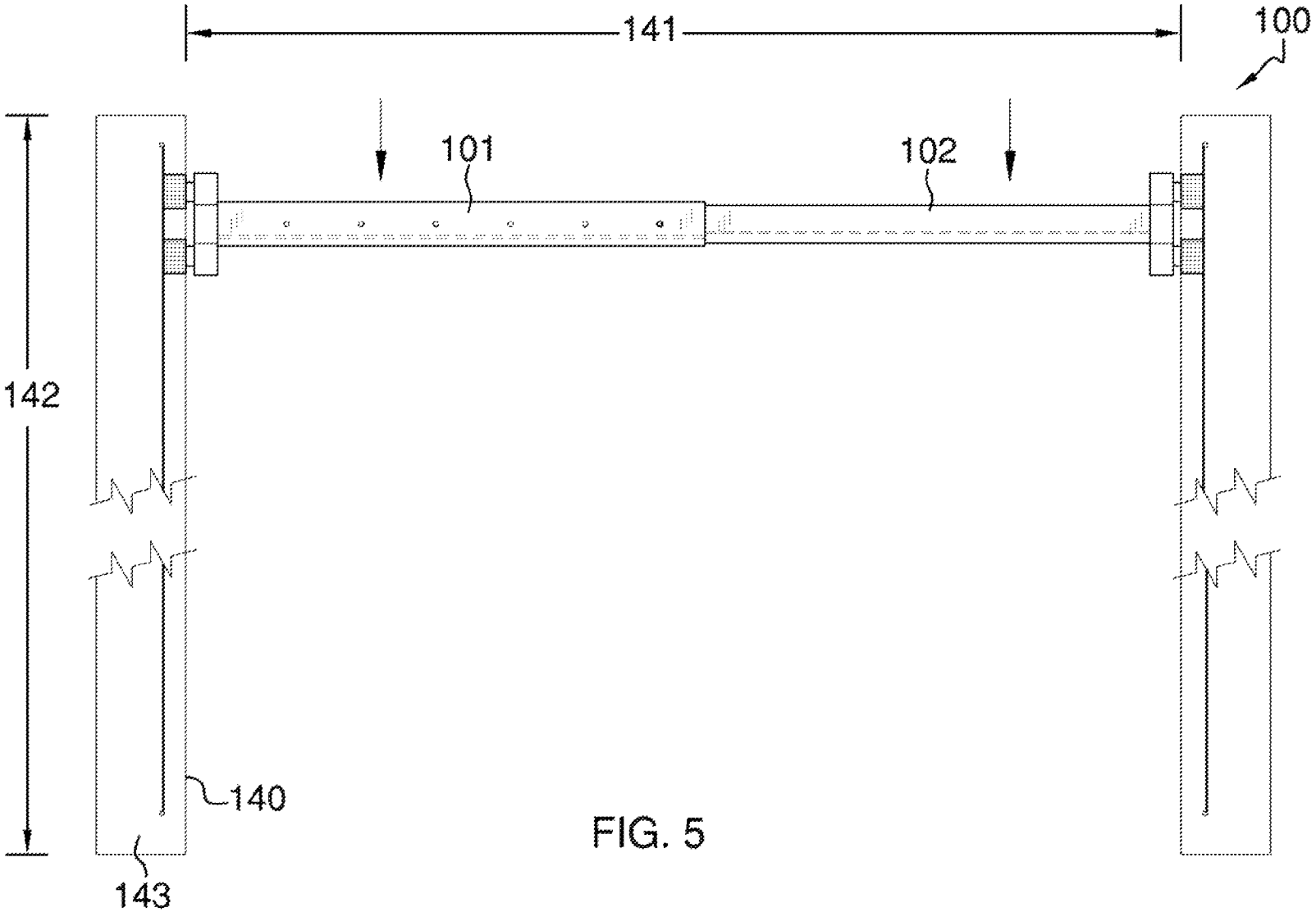
FIG. 5 illustrates a top view of the leveling and smoothing tool in use whereby a directional arrow indicates the movement of the tool along a length of the pieces of timber.
Figure 6:
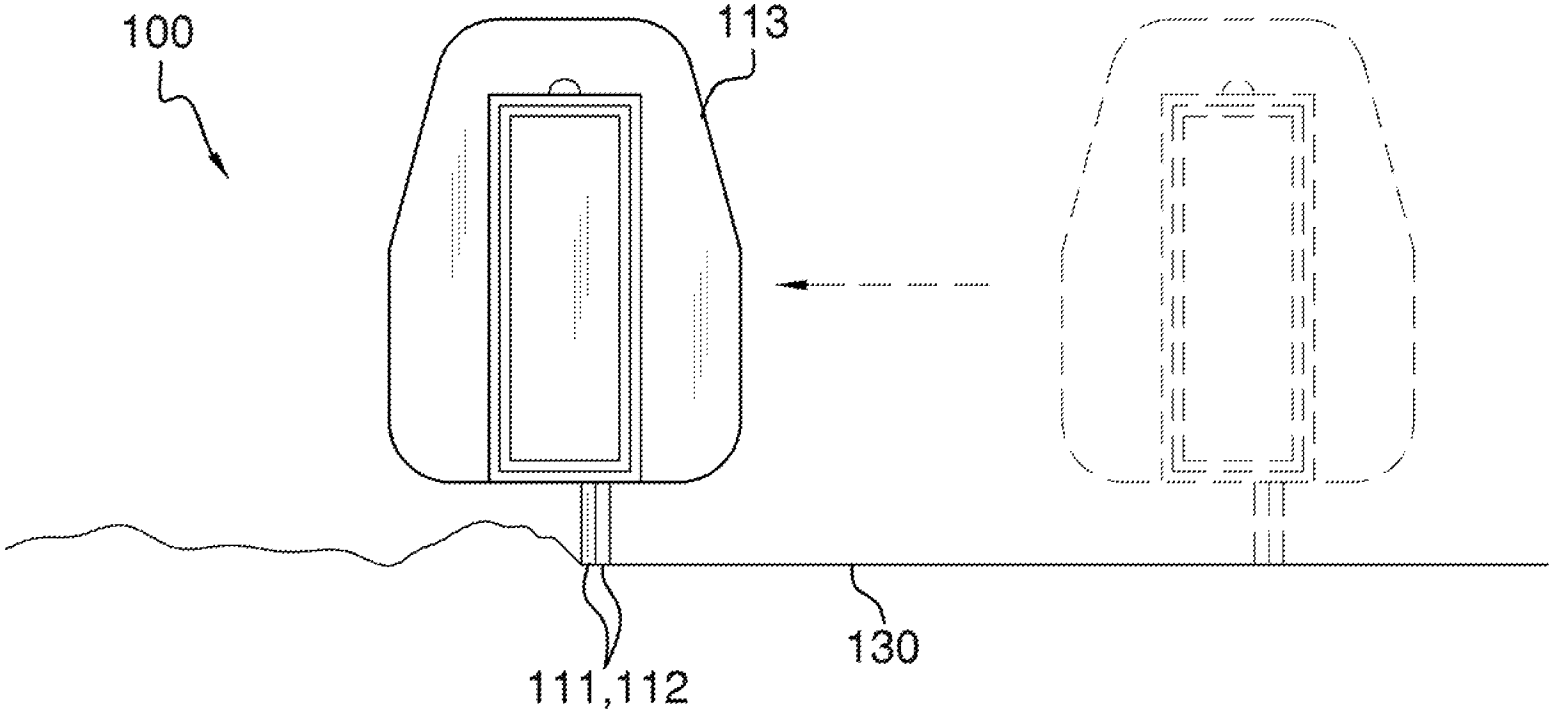
FIG. 6 illustrates a side view of the leveling and smoothing tool in use in which the blade members engage across the top surface of the material being smoothed and evened.

The blade members 111 and 112 are offset with respect to one another in order to enable the second telescoping member 102 to extend and retract with respect to the first telescoping member 101 (see FIGS. 4 and 5). The blade members 111 and 112 descend downwardly from the first bottom surface 109 and second bottom surface 110, respectively.

The first telescoping member 101 and the second telescoping member 102 each include a distal member 113 that include rollers 114 thereon. Moreover, the distal members 113 are each further defined with an inner side surface 115 and an outer side surface 116. The inner side surface 115 of the distal member 113 engages in rigid affixture to the respective first or second telescoping member 101/102. That being said, the outer side surface 116 of the distal member 113 is from which the rollers 114 extend. The rollers 114 are used to engage and roll along a top surface 143 of pieces of timber 140.

As previously mentioned, the timber 140 involves two generally parallel pieces of timber 140, and may be in the form of a 2 by 4 or other common size piece of lumber. The timber 140 is placed atop of the top surface 130 prior to use with the invention 100. The pieces of timber 140 shall be separated at a timber distance 141, which is equal to or larger than the overall tool length 104. The rollers 114 essentially rotate about themselves on the outer side surface 116 of the distal member 113, and when placed onto the pieces of timber 140 enable the invention 100 to be rolled along a timber length 142.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A screen limestone leveling and smoothing tool comprising:

a first telescoping member and a second telescoping member are each affixed with rollers, and blade members;

wherein said tool is rolled along two generally parallel pieces of timber in order for the blade members to smooth and level out a top surface of a material used as a subsurface for brick paver or interlocking stone surface;

wherein the first telescoping member and the second telescoping member are telescopically engaged with one another, and are both made of a hollowed construction whereby the second telescoping member extends and retracts with respect to the first telescoping member;

wherein the first telescoping member and the second telescoping member each have a rectangularly-shaped cross section, and the first telescoping member has a larger cross-sectional shape when compared to the second telescoping member;

wherein the first telescoping member and the second telescoping member each have a telescoping length such that both the first telescoping member and the second telescoping member are equal in length with respect to one another;

wherein an overall tool length is comprised of the length formed of the first telescoping member and an exposed portion of the second telescoping member;

wherein the first telescoping member is further defined with a top surface that includes a plurality of equally spaced holes there across; wherein the second telescoping member includes a spring-loaded button that is biased upwardly through a second top surface, and which aligns with one of the holes in order to lock the tool at an adjustable overall tool lengths;

wherein the first telescoping member is further defined with a first bottom surface whereby the second telescoping member has a second bottom surface; wherein the first telescoping member includes a first blade member that extends downwardly from the first bottom surface whereas the second telescoping member includes a second blade member that extends downwardly from the second bottom surface;

wherein the first blade member and the second blade member are offset with respect to one another.

2. The leveling and smoothing tool as described in claim 1 wherein the first telescoping member and the second telescoping member each include a distal member that includes rollers thereon.

3. The leveling and smoothing tool as described in claim 2 wherein the distal members are each further defined with an inner side surface and an outer side surface; wherein the inner side surface of the distal member engages in rigid affixture to the respective first telescoping member or second telescoping member; wherein the outer side surface of the distal member is from which the rollers extend; wherein the rollers engage and roll along a top surface of said pieces of timber.

4. The leveling and smoothing tool as described in claim 3 wherein the timber involves two generally parallel pieces of timber; wherein the timber is placed atop of the top surface prior to use with the tool.

5. The leveling and smoothing tool as described in claim 4 wherein the pieces of timber are separated at a timber distance, which is equal to or larger than the overall tool length; wherein the rollers roll along a timber length.

6. A screen limestone leveling and smoothing tool comprising:

a first telescoping member and a second telescoping member are each affixed with rollers, and blade members;

wherein said tool is rolled along two generally parallel pieces of timber in order for the blade members to smooth and level out a top surface of a material used as a subsurface for brick paver or interlocking stone surface;

wherein the first telescoping member and the second telescoping member are telescopically engaged with one another, and are both made of a hollowed construction whereby the second telescoping member extends and retracts with respect to the first telescoping member;

wherein the first telescoping member and the second telescoping member each have a rectangularly-shaped cross section, and the first telescoping member has a larger cross-sectional shape when compared to the second telescoping member;

wherein the first telescoping member and the second telescoping member each have a telescoping length such that both the first telescoping member and the second telescoping member are equal in length with respect to one another;

wherein an overall tool length is comprised of the length formed of the first telescoping member and an exposed portion of the second telescoping member;

wherein the first telescoping member is further defined with a top surface that includes a plurality of equally spaced holes there across; wherein the second telescoping member includes a spring-loaded button that is biased upwardly through a second top surface, and which aligns with one of the holes in order to lock the tool at an adjustable overall tool lengths;

wherein the first telescoping member is further defined with a first bottom surface whereby the second telescoping member has a second bottom surface; wherein the first telescoping member includes a first blade member that extends downwardly from the first bottom surface whereas the second telescoping member includes a second blade member that extends downwardly from the second bottom surface;

wherein the first blade member and the second blade member are offset with respect to one another;

wherein the first telescoping member and the second telescoping member each include a distal member that includes rollers thereon;

wherein the distal members are each further defined with an inner side surface and an outer side surface; wherein the inner side surface of the distal member engages in rigid affixture to the respective first telescoping member or second telescoping member; wherein the outer side surface of the distal member is from which the rollers extend; wherein the rollers engage and roll along a top surface of said pieces of timber.

7. The leveling and smoothing tool as described in claim 6 wherein the timber involves two generally parallel pieces of timber; wherein the timber is placed atop of the top surface prior to use with the tool.

8. The leveling and smoothing tool as described in claim 6 wherein the pieces of timber are separated at a timber distance, which is equal to or larger than the overall tool length; wherein the rollers roll along a timber length.

* * * * *